US005557827A

United States Patent [19]

Lautenschläger et al.

[11] Patent Number: 5,557,827

[45] Date of Patent: Sep. 24, 1996

[54] CABINET-WALL RELATED MEMBER FOR CABINET HINGES

[75] Inventors: Horst Lautenschläger; Reinhard Lautenschläger, both of Reinheim, Germany

[73] Assignee: MEPLA-Werke Lautenschläger GmbH & Co.KG, Germany

[21] Appl. No.: 439,623

[22] Filed: May 12, 1995

[30] Foreign Application Priority Data

Sep. 7, 1994 [DE] Germany ..... 44 31 827.8

[51] Int. Cl.[6] ..... E05D 7/04; E05D 5/00

[52] U.S. Cl. ..... 16/237; 16/270; 16/382

[58] Field of Search ..... 16/235, 236, 237, 16/238, 242, 243, 245, 246, 254, 257, 258, 270, 382, 383, 387, DIG. 40, DIG. 43

[56] References Cited

U.S. PATENT DOCUMENTS 4,007,514 2/1977 Salice ..... 16/382

5,295,282 3/1994 Lautenschlager ..... 16/237

FOREIGN PATENT DOCUMENTS 124396 2/1977 German Dem. Rep. .

4028653 3/1992 Germany .

9112453 4/1992 Germany .

9308673 12/1994 Germany .

*Primary Examiner*—Chuck Y. Mah

*Attorney, Agent, or Firm*—Dvorak and Traub

[57] ABSTRACT

A cabinet-wall member of a cabinet hinge in the form of an elongate arm which is stamped from initially flat sheet metal and shaped so that a flange is bent at a substantially right angle from each of its longitudinal edges such that the arm has an inverted channel-shaped cross section over most of its length. The flanges are additionally stiffened over at least a portion of their length—e.g., by embossing at least one bead running lengthwise of the arm.

9 Claims, 1 Drawing Sheet

CABINET-WALL RELATED MEMBER FOR CABINET HINGES

BACKGROUND OF THE INVENTION

1. Field of the Invention

The invention relates to the cabinet-wall related member of a furniture hinge in the form of an elongate arm which is stamped from initially flat sheet metal and formed into a channel with sides at right angles to its web.

2. Brief Description of the Prior Art

Modern furniture hinges, especially four-joint or also cross-link hinges, are attached to the side of the carcase by means of a cabinet-wall related hinge member of the kind described above, wherein the elongate arm is held for adjustment in at least two coordinate directions on a mounting plate affixed to the carcase. Whereas these arms were originally made to a great extent of metal—by die-casting from zinc alloys, for example—their manufacture by stamping from sheet metal has recently become more widespread. Making the arms out of initially flat sheet metal permits the reduction of the wall thickness of the supporting arms and thus a reduction of weight due to the greater strength of sheet metal as compared with die-cast metals. Provision is made for the various stresses produced on the carcase by doors of different weight by increasing the size of the arms and by using different thicknesses of the sheet metal. In the case of large doors, especially those that are tall and consequently heavy, it may be necessary to increase the number of hinges to limit the stress on each individual hinge. In any case, however, the need exists for optimizing the load-bearing capacity of sheet metal hinges as well as their ability to withstand the shocks that can be produced by door slamming.

SUMMARY OF THE INVENTION

The invention is addressed to the problem of increasing the stress resistance of such hinge members made by stamping from sheet metal without thereby having to resort to the use of materials of greater thickness.

Setting out from a cabinet-wall related hinge member of the kind described above, this problem is solved according to the invention by additionally stiffening the flanges over at least part of their length.

This additional stiffening of the flanges of the arm can be accomplished for example by creating at least one reinforcing bead on the flanges, running lengthwise along the flanges. This reinforcing bead, which is created by additional pressing at an intermediate station, leads to an appreciable improvement of strength both due to the cold working of the material of the flanges and due to the improvement of the form factor of the arm.

Alternatively, or in addition, a strip scored in the material at the bottom margin of each flange can be folded back 180° against either the inside or outside of the flange.

At the outside end of the arm, i.e., the end nearer the door opening of the cabinet, a portion of modern articulated hinges is provided with a cut-out to accommodate the joint hinge members in the form of links or linking arms connecting the arm to the door-related hinge member. In hinges of this kind it is expedient that the reinforcing means extend into the front end of the flanges where they are not connected together by the web, although this increases stiffness even in those hinge arms which do not have a cut-out in the web, and therefore it is advantageous to do it.

If the flanges are stiffened by reinforcing beads running lengthwise, it is possible also to create at least one, preferably transverse bead in the web, and then make continue it on until it joins the longitudinal reinforcing bead in each flange.

The transverse reinforcing bead, or one of the transverse beads, is best provided in the front end portion of the web adjacent the linking mechanism.

BRIEF DESCRIPTION OF THE DRAWINGS

The invention is further explained in the description that follows of a number of embodiments, in conjunction with the drawing, wherein.

DETAILED DESCRIPTION OF THE INVENTION

Figure 1:
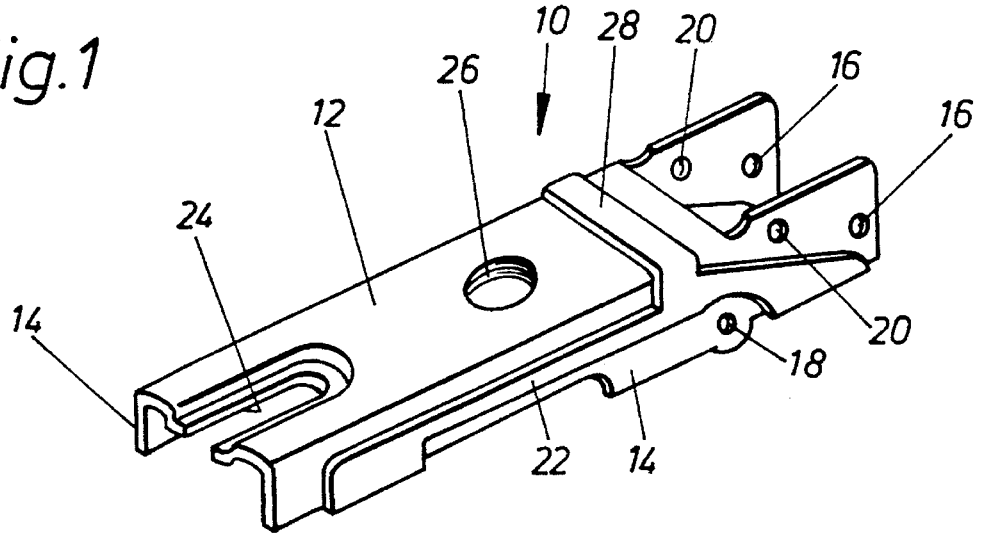
FIG. 1 represents a perspective view of a first embodiment of a hinge arm configured in the manner of the invention.

FIG. 1 is a perspective representation of an arm identified as a whole by 10, which constitutes the wall-related member of a four-joint furniture hinge, not otherwise represented, which can serve in conjunction with at least one similar hinge for hanging a door on the carcase of the corresponding cabinet. The hinge arm made by stamping from sheet steel has an elongate web 12 from whose two opposite margins flanges 14 are to bent about 90°, so that the arm has an inverted, channel-shaped cross section over the greater part of its length. At the right end, as seen in the drawing, the flanges 14 extend further beyond the web and thus form a space between the flanges, yet wide enough for the entry of the links of the four-joint hinge. The said links are pivoted at the arm end, in a known manner, on pivot pins, not shown, which are riveted or upset in bores 16 and 18 in the flanges 14. Of the bores 18 only the bore provided in the front-facing flange 14 can be seen, while the bore provided in the second flange is concealed in the drawing by the flange 12. A pair of additionally provided bores 20 is associated with the mounting of parts of a closing mechanism which has nothing to do with the present invention and therefore they are not further described. In the case of hinge arms for hinges with or without a different closing mechanism the bores 20 may also be omitted.

To stiffen the hinge arm in general an elongated reinforcing bead 22 is embossed in each of the two flanges such that it protrudes outwardly from the outer surface of the flange. This bead 22 extends over most of the length of the flanges 14, and in the illustrated case it extends still further into the front area not covered by the web 12; such surface areas, in which the bores 16, 18 or 20 are punched, lie outside of the bead 22. At the opposite end—the cabinet-interior end—the bead ends slightly ahead of the actual end of the arm, continuing then, in the embodiment represented, to the bottom free margin of the flange 14. In this manner an internal indentation is created in this area on the inner sides of the flanges, but it is not related to the increase of the strength of the hinge arm that the invention seeks, and therefore is not essential to the invention. In other words, the indentation could be carried all the way to the end or simply terminate before the end.

For the adjustable mounting of the arm 10 on the corresponding mounting plate there is provided in the rear end of the web a recessed open-ended slot 24 through which a screw can be driven into the mounting plate. Furthermore, a tap 26 is also provided in the web bearer the front, linkage end, and a threaded spindle can be driven into it. Both the open-ended and recessed slot 24 and the tap 26 are provided also in known hinges of similar configuration, i.e., they have no connection with the present invention.

However, what is connected with the invention is the upwardly protruding embossed bead 28 which is provided between the tap 26 and the front end of the web 12 resulting in a transverse reinforcement, and which continues at its ends beyond the web and into the longitudinal beads 22, and thus stiffens the hinge arm, especially in its front end adjacent the linkage. A similar transverse bead might also be provided in the area between the tap 26 and the open-ended slot 24, but with regard to the stresses encountered at that point it does not have the same effect and therefore it is not provided in the example represented.

Figure 2:
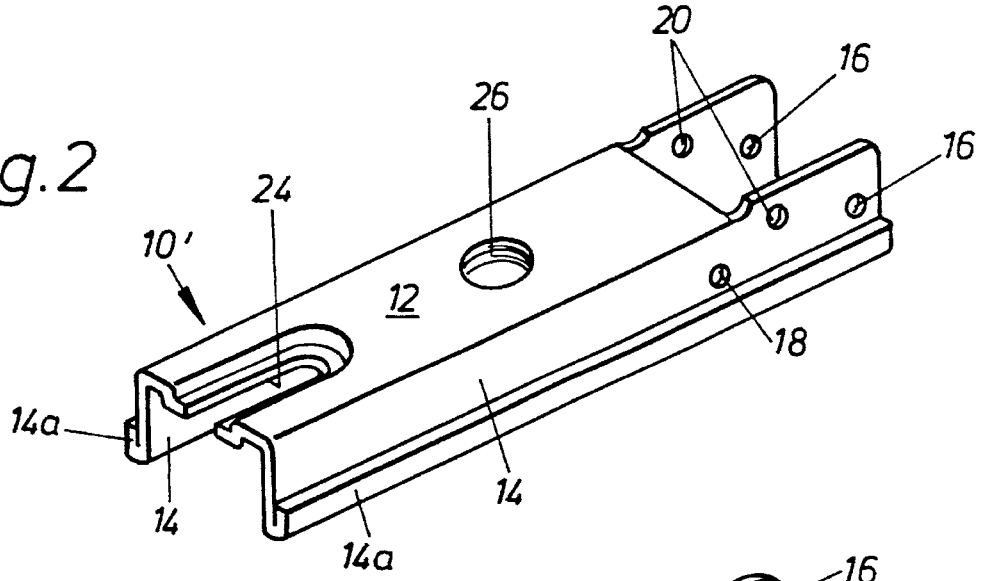
FIG. 2 a second embodiment in a modified arm.

The hinge arm 10' represented in FIG. 2 is a variant of the hinge arm 10 described above in connection with FIG. 1. Since equal parts of the two arms are provided with the same reference numbers in the figures, only the differences will be described, since it is sufficient to refer to the above description for the rest. The essential difference between arm 10' and arm 10 is that in arm 10' the reinforcement is provided by strips 14*a* scored along the full length of the bottom margins of flanges 14 and bent outwardly against the latter, thus providing the desired stiffening.

Figure 3:
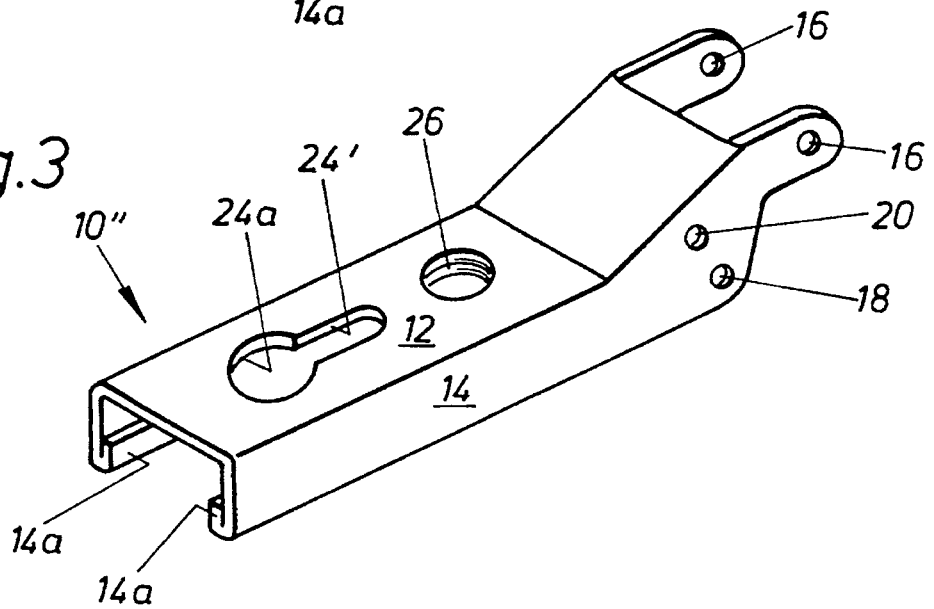
FIG. 3 a third embodiment of a hinge arm according to the invention.

An additional variant arm 10" is represented in FIG. 3, and differs from the arm 10' as regards the stiffening in that the strips 14*a* scored on the flanges 14 and folded 180° are in this case folded against the inside surfaces of the flanges 14, rendering them invisible from the exterior. The possibly aesthetically better external appearance of this embodiment is obtained at the expense of reducing the internal free space between the flanges, which may require making the arm broader.

In this case the hinge arm differs as regards installing it on the mounting plate in that the fastening at the back end is accomplished not by an open-ended slot, but it has instead a slot 24' closed at both ends and terminating in a known manner in a pass-through opening 24*a* of enlarged diameter.

What is claimed is:

1. An elongated hinge arm member of a furniture hinge (10, 10', 10") for attachment to a mounting plate affixed to a cabinet wall, the hinge arm having a lengthwise direction, comprising:

a web having a surface (12) and a pair of oppositely lying lateral longitudinal margins;

lateral flanges (14), having both an inner and an outer flat side, turned down at substantially right angles from each of the lateral longitudinal margins so that the hinge arm has a generally inverse U-shaped cross-sectional configuration; and reinforcement means over at least a portion of the length of each lateral flange, wherein the reinforcement means comprises at least one bead (22) embossed into each lateral flange in the lengthwise direction of the flange.

2. The hinge arm member according to claim 1, further comprising a linkage mechanism at a front end area of the hinge arm (10, 10', 10"), wherein a portion of the web (12) is cut away from between the lateral flanges (14), and wherein the reinforcement means (22, 14*a*) of the flanges (14) extends into the front end area of the hinge arm.

3. The hinge arm member according to claim 1, further comprising at least one transverse bead (28) embossed into the web (12).

4. The hinge arm member according to claim 3, wherein the transverse bead (28) embossed into the web (12) extends into each lateral flange until it joins the longitudinal bead (22) in each lateral flange (14).

5. The hinge arm member according to claim 4, further comprising a front link mechanism end of the web (12) and wherein said at least one transverse bead (28) is provided in the front link mechanism end of the web (12).

6. The hinge arm member according to claim 3, wherein one end of the web comprises bores (15, 18) for the arrangement of a front link mechanism, and wherein at least one of the transverse beads (28) is provided in said front link mechanism end of the web (12).

7. An elongated hinge arm member of a furniture hinge (10, 10', 10") for attachment to a mounting plate affixed to a cabinet wall, the hinge arm having a lengthwise direction, comprising:

a web surface (12) and a pair of oppositely lying lateral longitudinal margins;

lateral flanges (14), having both an inner and an outer flat side, turned down at substantially right angles from each of the lateral longitudinal margins so that the hinge arm has a generally inverse U-shaped cross-sectional configuration; and reinforcement means over at least a portion of the length of each lateral flange, wherein the reinforcement means comprises a strip (14*a*) of a bottom margin of each flange folded back 180° against one of the flat sides of the flange.

8. The hinge arm member according to claim 7, wherein the strip (14*a*) is folded against the inner flat side of each associated flange (14).

9. The hinge arm member according to claim 7, wherein the strip (14*a*) is folded back against the outer flat side of each associated flange (14).

* * * * *